United States Patent [19]

Shigeji

[11] 4,051,610

[45] Oct. 4, 1977

[54] SANDAL

[76] Inventor: Yoshihiro Shigeji, 5-7-7 Okamotocho, Higashinadaku, Kobe, Japan

[21] Appl. No.: 683,217

[22] Filed: May 4, 1976

[51] Int. Cl.[2] ..... A43B 3/12

[52] U.S. Cl. ..... 36/11.5

[58] Field of Search ..... 36/11.5, 100, 101

[56] References Cited

U.S. PATENT DOCUMENTS

| | | | |
|---|---|---|---|
| 2,761,224 | 9/1956 | Gardiner | 36/11.5 |
| 3,290,802 | 12/1966 | Fukuoka | 36/11.5 |
| 3,336,683 | 8/1967 | Schellkopf | 36/11.5 |
| 3,978,596 | 9/1976 | Brown et al. | 36/11.5 |

*Primary Examiner*—Patrick D. Lawson

*Attorney, Agent, or Firm*—Wenderoth, Lind & Ponack

[57] ABSTRACT

A sandal which is formed with a sole member and a thong member removably attached to the sole member for holding the sandal wearer's foot against the sole member. The thong member may be alternatively fitted over only the wearer's instep or a portion of the thong member may be withdrawn from the position of covering the wearer's instep and be positioned around the wearer's heel.

1 Claim, 3 Drawing Figures

SANDAL

The present invention relates to relatively simply constructed sandals for use mainly during recreational activities.

BACKGROUND OF THE INVENTION

Conventional sandals for use at the beach, poolside or related activities, generally slip on and off the wearer's feet quite easily but are somewhat securely held at the instep portion of the foot by a single split thong which fits over the instep. Though this is a convenient feature, there is the important drawback in that there is no practical way to keep the sandals on the wearer's feet while he is walking on rough surfaces, running or walking in water. The heel portion of the foot is too easily separated from the sandal.

SUMMARY OF THE INVENTION

In light of the above-mentioned drawback prevelant in conventional sandals, the present invention is designed to provide a sandal which overcomes this drawback, but which at the same time is as convenient to wear. The sandal of the present invention has the same style flexible thong fitted over the instep of the wearer, but this thong is divided into two parts, one of which is secured to the sole of the sandal and fitted over the wearer's instep and the other of which is fittable over the wearer's instep, but is also bendable away from the second thong to fit around the wearer's heel.

BRIEF DESCRIPTION OF THE DRAWINGS

Other objections will be apparent from the following detailed description of a preferred embodiment taken in conjunction with the accompanying drawings in which.

DETAILED DESCRIPTION OF THE INVENTION

Figure 1:
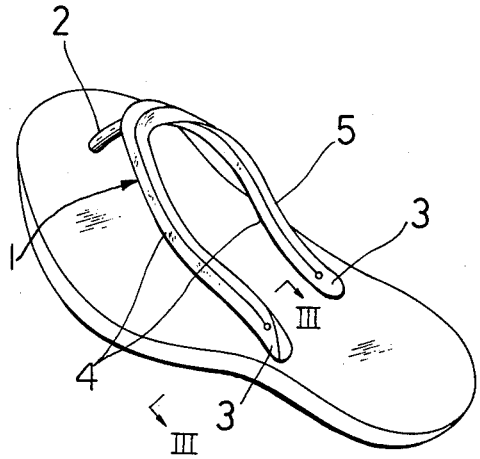
FIG. 1 is a perspective view of a sandal in accordance with the present invention.
Figure 2:
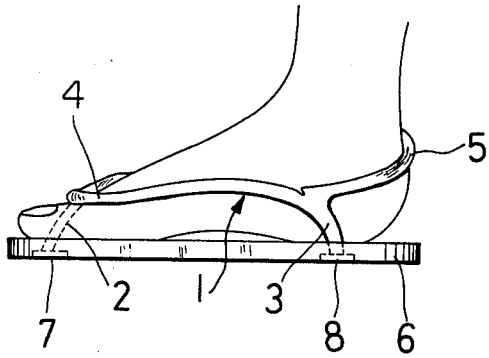
FIG. 2 is a side view showing the back thong fitted around the upper portion of the wearer's heel.
Figure 3:
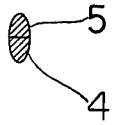
FIG. 3 is a section view taken along the line III — III of FIG. 1.

As shown in FIGS. 1 and 2, the sandal of the present invention has a sole member 6 with a thong member 1 attached thereto. Both the sole member and the thong may be made of any lightweight material such as rubber or vinyl chloride. In addition, the sole member may be produced by press stamping.

The thong member 1 is made up of several parts 2, 3, 4 and 5. A piece 2 is formed to the forward portion of a foot strap 4 and has a base portion, opposite the end formed to the foot strap 4, which is fitted into a bore 7 through the forward portion of said sole. In this manner, the forward portion of the thong member 1 is secured to the sole member 6.

The rear portions 3,3 of the foot strap 4 also have base portions which are fitted into two holes 8,8 in the rear portion of the sole member 6. By inserting the base portions of the toe piece 2 and the rear portions 3,3 into the holes 7,8,8 respectively, the thong member 1 is securely held to the sole member at three points. Separation of the sole member 6 and the thong member 1 at these three points 7,8,8 permits easy transportation and storage of each member separately.

The foot strap 4 has integrally formed at the ends thereof near said rear portions 3,3 a heel strap 5. When the heel strap 5 is not drawn back and positioned around the heel of the wearer as shown in FIG. 2, it is folded forward and lies adjacent the foot strap 4 as shown in FIG. 1. In this forward position, the heel strap 5 simply helps to form a wider foot strap 4 to fit across the wearer's instep.

To wear the sandals of the present invention, the front piece 2 and the rear portions 3,3 of the thong member 1 are inserted into and held within the holes 7,8,8 respectively in the sole member 6. At the wearer's option, the heel strap 5 integrally formed with the foot strap 4 may be folded forward and the sandal will be held to the wearer's foot simply by the foot strap 4 and heel strap 5 fitting over the wearer's instep; the wearer's heel will be free to separate from the rear portion of the sole 6. On the other hand, if it is desired to hold the wearer's heel snuggly against the rear portion of the sole, the heel strap 5 can be drawn back from its forward position adjacent the foot strap 4 and positioned around the wearer's heel. In this rearward position, the heel strap 5 completely prevents the sandal from slipping off the wearer's foot.

It will be apparent that various modifications may be made to the above specifically described structural arrangements without departing from the scope of the invention.

What is claimed is:

1. A sandal comprising:

a sole member means for supporting and protecting the sandal wearer's foot; and thong member means removably attached to said sole member means for fitting over the wearer's instep and for selectively fitting over the wearer's instep and around the wearer's heel, said thong member means being comprised of:

a foot strap removably connected to said sole member means having a longitudinal slit therein forming two complementary adjacent straps integrally connected at their ends, one of said straps being selectively removable from the other and fitable around the wearer's heel.

* * * * *